United States Patent [19]

Barbano

[11] Patent Number: 4,479,127

[45] Date of Patent: Oct. 23, 1984

[54] BI-LOOP ANTENNA SYSTEM

[75] Inventor: Normand Barbano, Sunnyvale, Calif.

[73] Assignee: GTE Products Corporation, Stamford, Conn.

[21] Appl. No.: 412,743

[22] Filed: Aug. 30, 1982

[51] Int. Cl.[3] ..... H01Q 11/14

[52] U.S. Cl. ..... 343/742; 343/700 MS

[58] Field of Search ..... 343/742, 700 MS, 743, 343/744

[56] References Cited

U.S. PATENT DOCUMENTS 2,657,313 10/1953 Antony ..... 343/742

FOREIGN PATENT DOCUMENTS 12645 6/1980 European Pat. Off. ..... 343/742

*Primary Examiner*—Eli Lieberman
*Assistant Examiner*—K. Ohralik
*Attorney, Agent, or Firm*—John F. Lawler

[57] ABSTRACT

A bi-loop antenna system comprises an array of four bi-loop antennas equally spaced from the array axis and fed in phase and with equal power. Each antenna comprises an electrical conductor configured as two substantially identical open-ended coplanar loops, preferably square in shape, having colinear axes parallel to the array axis and electrically connected together, the open ends defining two closely spaced feed points at the middle of the array. The array is fed by a four-way coaxial power divider with output ports connected to the antennas, respectively, remote from the feed points thereof by coaxial lines of equal length. A balun comprising a portion of one of the loops of each antenna and a closely spaced coextensive conductive strip connects the inner and outer conductors of the coaxial cable to the two feed points, respectively, of the antenna. In a preferred embodiment, the conductors of each antenna are formed on a dielectric sheet or board by printed circuit techniques. This antenna system produces a horizontally polarized omnidirectional radiation pattern over an octave bandwidth and has a VSWR response of the input impedance with a value less than 2:1 over the octave bandwidth.

4 Claims, 3 Drawing Figures

BI-LOOP ANTENNA SYSTEM

This invention was made under a contract with the Department of the Air Force.

BACKGROUND OF THE INVENTION

This invention relates to antennas and more particularly to an improved antenna array capable of producing omnidirectional radiation over an octave bandwidth.

Certain applications of radio frequency communications such as ground station transceivers require an antenna having a horizontally polarized omnidirectional radiation pattern and a voltage standing wave ratio (VSWR) value of 2:1 or lower over an entire octave frequency bandwidth. Such performance is not obtainable with prior art antennas.

One prior art antenna, the Lindenblad antenna described by G. H. Brown and O. M. Woodward, Jr. in "Circularly-Polarized Omnidirectional Antenna", RCA Review, Volume VIII, No. 2; June 1947, pp. 259–269, consists of four half-wave dipole elements fed from a centrally located coaxially line feeder and oriented to lie in a common plane in the form of a square pattern. The dipoles are individually fed from a two-wire transmission line. Four of these lines extend radially from the feeder line to the inputs of the dipoles. The characteristic impedance of the line is selected to optimize the impedance match between the dipoles and the coaxial feed line. While this antenna provides good horizontally polarized radiation patterns over an octave bandwidth, attempts to achieve an impedance match with a VSWR of 2:1 or lower over the same bandwidths have not been successful.

Other approaches exist whereby horizontally polarized radiation patterns are produced. Some of these include different versions of the turnstile antenna, slotted cylinders, the circular-loop antenna, clover leaf antenna, triangular-loop antenna, and square-loop or Alford-type antenna. All of these antennas, without exception, are narrow-band devices in the sense that the impedance bandwidth covers less than an octave.

Still another approach consists of a log-periodic array of turnstile elements. This antenna produces horizontally polarized omnidirectional radiation patterns over an octave bandwidth and even a wider bandwidth if the antenna elements are properly sized. However, the problem with the antenna, like the others, is that its input impedance match has a VSWR greater than 2:1 over an octave bandwidth.

OBJECTS AND SUMMARY OF THE INVENTION

A general object of the invention is the provision of an antenna array which provides omnidirectional radiation patterns with a VSWR response of 2:1 or lower over an octave bandwidth.

This and other objects of the invention are achieved with an antenna array having a plurality of bi-loop antennas with axes parallel to and equally spaced from the array axis and fed with equal power and phase. Each antenna has two identical conductor loops connected together at two laterally spaced feed points which are connected to an unbalanced (coaxial) input feed line by a balun comprising a portion of one of the two loops of the antenna and a closely spaced coextensive conductive strip.

DESCRIPTION OF PREFERRED EMBODIMENT

Figure 1:
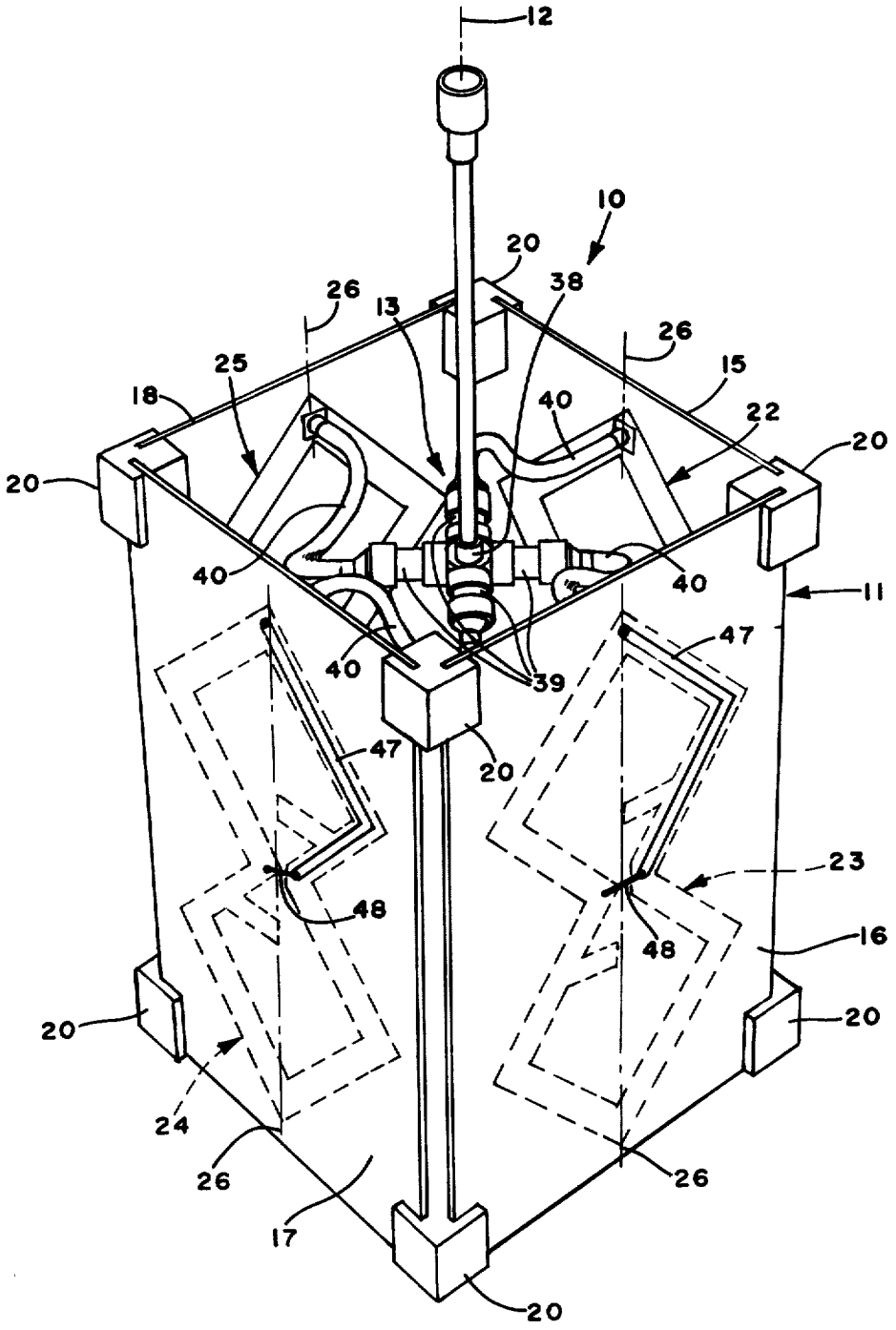
FIG. 1 is a perspective view of an antenna array embodying this invention.

Referring now to the drawings, FIG. 1 shows an antenna system 10 comprising an array 11 of antennas having an axis 12, and a feed device 13 connected to array 11.

Array 11 preferably is an open-ended four-sided box-like structure comprised of substantially identical plane dielectric sheets or boards 15, 16, 17 and 18 of fiberglass or the like secured together by dielectric corner blocks 20. Boards 15 and 17 are parallel, boards 16 and 18 are parallel and perpendicular to the planes of boards 15 and 17, and all of the boards are equally spaced from axis 12 of the array. Affixed to the interior surfaces of the dielectric boards are four substantially identical bi-loop antennas 22, 23, 24 and 25 each having an axis 26 extending parallel to array axis 12.

Figure 2:
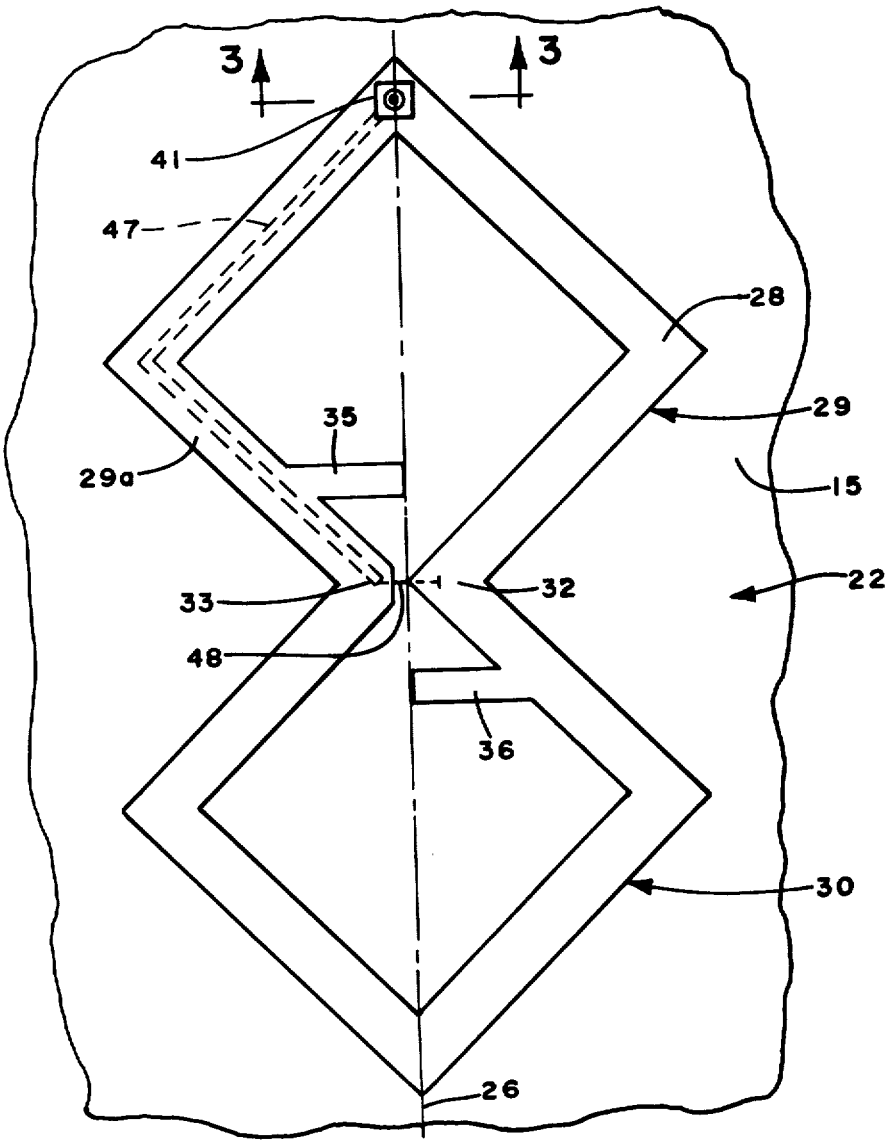
FIG. 2 is an enlarged side view of one of the bi-loop antennas forming part of the invention.

Each bi-loop antenna comprises a continuous conductor 28 in the form of a band or strip configured into two identical open-ended loops 29 and 30, see FIG. 2, having colinear axes comprising axes 26 and joined together at their ends as indicated at 32 and 33, which junctions constitute the feed points of the antenna. Conductor 28 is applied to the dielectric board by the well-known printed circuit techniques and is a relatively thin film of copper or the like, the width of which is determined by the desired impedance of the antenna. Loops 29 and 30 have inwardly projecting conductive stubs 35 and 36, respectively, the location, width and length of the stubs determining the desired impedance of the antenna.

Feed device 13 comprises a four-way coaxial power divider for equally dividing RF power from an input port 38 to the four output ports 39, the latter being connected by identical coaxial lines 40, respectively, to the upper extremities (as viewed) of the four antennas. Coaxial lines 40 have the same length and accordingly power transferred between power divider 13 and the four antennas is equal both in phase and in magnitude. The power divider is commercially available and may, for example, be Model D-4-ITN manufactured by Microlab FXR Co., Livingston, N.J.

Figure 3:
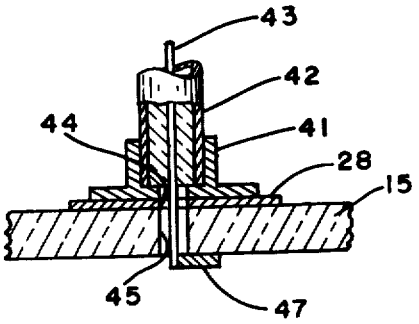
FIG. 3 is an enlarged transverse section taken on line 3—3 of FIG. 2.

Coaxial lines 40 are connected to the antennas by identical connectors 41; it will be sufficient for an understanding of the invention that the connection of the coaxial line to one antenna, namely antenna 22, be described. Line 40 has an outer conductor 42 and an inner conductor 43. Outer conductor 42 is directly electrically connected to the upper extremity (as viewed) of associated antenna conductor 28 by connector 41, see FIG. 2 and 3, while inner conductor 43 extends through aligned openings 44 and 45 in antenna conductor 28 and board 15, respectively.

In order to transform the unbalanced feed of coaxial line 40 to a balanced feed of antenna 22, a conductive strip 47 is formed on the side of board 15 opposite from antenna 22, i.e., on the exterior surface of board 15, between coaxial line 40 and feed point 33 and coextensive with the one-half portion **29*a* of the antenna loop 29 therebetween. Strip 47 is directly electrically connected to inner conductor 43 of the coaxial line at one end and at the opposite end via jumper 48 to feedl point 32. Strip 47 and loop portion 29***a* constitute a balun or transformer which converts the unbalanced feed to a balanced feed for the antenna. In addition, the balun provides a broadband impedance match between the coaxial line which typically has a characteristic impedance of 50 ohms and the antenna feed point which may have a characteristic impedance of about 75 ohms. The transformation ratio of the balun is adjusted by selection of the width of strip 47. If the antenna is fed with a 75 ohm coaxial cable, the transformation ratio of the balun is 1:1 or, alternatively, the coaxial cable is directly connected to the antenna feed points thereby eliminating the need for the balun.

This invention is concerned with the bi-loop antenna array. The individual antennas 22, 23, 24 and 25 separately and apart from their combination in the array do not, per se, constitute this invention.

The impedance response of the bi-loop antenna array with opposite elements spaced 7.5 inches was measured in free space and was found to be less than 2:1 over a 2.4:1 frequency range, which is well over an octave band. The impedance response of this antenna array was also examined with the array placed directly on a flat ground plane. The response was substantially unaffected over the same frequency band mentioned above. Radiation patterns were also measured over a 2:1 frequency bandwidth and the resulting E-plane and H-plane patterns demonstrated excellent omnidirectional properties of the bi-loop array. The principal plane pattern is substantially circular with a peak gain of 1.6 dB. The cross-polarized component was fairly low in values, being about 15 to 10 dB below the peak of the principal pattern response. The H-plane measurement produced a very good "figure 8" pattern. Such patterns existed for both E-plane and H-plane over the full octave operating frequency range of the antenna.

Another feature of this antenna is that it can be made to have a large power handling capacity, limited only by the four-way power divider component. For example, if 400 watts is applied to the antenna, while the power divider would necessarily be required to handle this power, only 100 watts would be applied to each antenna element.

What is claimed is:

1. An antenna system comprising an array having four antennas disposed in a first pair of parallel planes and in a second pair of parallel planes, respectively, said first and second pairs of planes being perpendicular to each other, the antennas of each pair being equally spaced apart, each antenna comprising a continuous electrical conductor configured as two open ended substantially square and identical loops connected together at the open ends to constitute two spaced feed points, said loops of each antenna having colinear diagonals extending parallel to corresponding diagonals of said loops of the other antennas, means to feed said array of antennas comprising a power divider having an input port and four output ports, four coaxial cables having equal lengths and respectively connected between said output ports and said antennas, each of said cables having an inner conductor and an outer conductor, the outer conductors of said cables being electrically connected to the loop conductors, respectively, the inner conductor of each of said cables being electrically connected to one of said feed points of the antenna to which the corresponding outer conductor is connected.

2. The system according to claim 1 with a conductive strip for each of said antennas interconnecting the feed point thereof and the inner conductor of the associated cable, said strip being coextensive with and spaced closely to the portion of said electrical conductor defining one-half of the antenna loop and being connected to the opposite feed point.

3. The system according to claim 2 with four plane dielectric sheets, said antennas being mounted on said sheets, respectively, said strip and said loop conductor portion of each antenna being attached to opposite sides, respectively, of the associated sheet.

4. The system according to claim 3 in which said loop conductor and said strip comprise printed transmission lines.

* * * * *